US008016148B2

(12) United States Patent
Walsh

(10) Patent No.: US 8,016,148 B2
(45) Date of Patent: Sep. 13, 2011

(54) NECKED-IN CAN BODY AND METHOD FOR MAKING SAME

(75) Inventor: William J. Walsh, Lombard, IL (US)

(73) Assignee: Rexam Beverage Can Company, Chicago, IL (US)

( * ) Notice: Subject to any disclaimer, the term of this patent is extended or adjusted under 35 U.S.C. 154(b) by 1241 days.

(21) Appl. No.: 11/676,617

(22) Filed: Feb. 20, 2007

(65) Prior Publication Data

US 2008/0011702 A1 Jan. 17, 2008

Related U.S. Application Data

(63) Continuation-in-part of application No. 29/262,849, filed on Jul. 12, 2006, now Pat. No. Des. 554,000.

(51) Int. Cl.
*B65D 1/02* (2006.01)

(52) U.S. Cl. ..... 220/288; 215/44

(58) Field of Classification Search ..... 215/44; 220/288, 906

See application file for complete search history.

(56) References Cited

U.S. PATENT DOCUMENTS

| | | | | |
|---|---|---|---|---|
| 1,443,682 | A | | 1/1923 | Gueritey |
| 1,621,487 | A | | 3/1927 | Aulbach |
| 2,195,257 | A | | 3/1940 | Paris |
| 2,337,616 | A | | 12/1943 | McManus et al. |
| 2,384,810 | A | * | 9/1945 | Calleson et al. ..... 220/658 |
| 3,995,572 | A | | 12/1976 | Saunders |
| D245,964 | S | | 10/1977 | Sexton et al. |
| D246,030 | S | | 10/1977 | Sexton et al. |
| D246,229 | S | | 11/1977 | Saunders |
| D247,772 | S | | 4/1978 | Sexton, Jr. |
| D250,933 | S | | 1/1979 | Saunders |
| D271,281 | S | | 11/1983 | Abbott et al. |
| D271,854 | S | | 12/1983 | Berry |
| 4,441,354 | A | | 4/1984 | Bodega |
| D275,834 | S | | 10/1984 | Slade |
| 4,643,330 | A | | 2/1987 | Kennedy |
| D290,811 | S | | 7/1987 | Cleveland, Jr. |
| 4,844,270 | A | | 7/1989 | Coffman |
| 4,892,214 | A | | 1/1990 | Hamaguchi et al. |

(Continued)

FOREIGN PATENT DOCUMENTS

| | | |
|---|---|---|
| BE | 376464 | 11/1931 |

(Continued)

OTHER PUBLICATIONS

International Search Report for PCT/US08/54212 mailed Jun. 25, 2008.

*Primary Examiner* — Sue A Weaver
(74) *Attorney, Agent, or Firm* — Ungaretti & Harris LLP

(57) ABSTRACT

A metal container is described. The metal container has a lower portion and an upper portion. The lower portion has an enclosed bottom and a cylindrical sidewall extending upwardly from the enclosed bottom portion. The cylindrical sidewall has a diameter and is centered about a longitudinal axis. The upper portion has a circumferential shoulder portion, a circumferential neck and an open end. The shoulder is integral with an uppermost portion of the cylindrical side wall and is smoothly tapered radially inwardly. The circumferential neck extends upwardly and radially inwardly from an uppermost portion of the circumferential shoulder. The open end is connected to the circumferential neck and has threads for threadable attachment to a closure member.

16 Claims, 8 Drawing Sheets

U.S. PATENT DOCUMENTS

| | | | | |
|---|---|---|---|---|
| D319,580 | S | 9/1991 | Cassai et al. | |
| 5,052,576 | A | 10/1991 | Budenbender | |
| 5,061,140 | A | 10/1991 | Hamaguchi et al. | |
| D327,218 | S | 6/1992 | Nickerson | |
| 5,135,124 | A | 8/1992 | Wobser | |
| 5,190,181 | A | 3/1993 | Budenbender | |
| 5,293,765 | A | 3/1994 | Nussbaum-Pogacnik | |
| 5,355,710 | A | 10/1994 | Diekhoff | |
| D353,771 | S | 12/1994 | Klitsner | |
| 5,448,903 | A | 9/1995 | Johnson | |
| D369,977 | S | 5/1996 | Sexton, Jr. | |
| D371,075 | S | 6/1996 | Stonehouse | |
| 5,557,963 | A | 9/1996 | Diekhoff | |
| 5,572,893 | A | 11/1996 | Goda et al. | |
| 5,605,248 | A | 2/1997 | Jentzsch | |
| 5,660,301 | A | 8/1997 | Kaplowitz | |
| D384,888 | S | 10/1997 | Diekhoff | |
| 5,704,240 | A | 1/1998 | Jordan | |
| 5,711,447 | A | 1/1998 | Plester | |
| 5,713,235 | A | 2/1998 | Diekhoff | |
| 5,718,352 | A | 2/1998 | Diekhoff et al. | |
| 5,778,723 | A | 7/1998 | Diekhoff | |
| 5,822,843 | A | 10/1998 | Diekhoff et al. | |
| 5,875,909 | A | 3/1999 | Guglielmini | |
| 5,881,907 | A | 3/1999 | Schutz | |
| 6,010,026 | A | 1/2000 | Diekhoff et al. | |
| 6,010,028 | A | 1/2000 | Jordan et al. | |
| 6,105,807 | A | 8/2000 | McCrossen | |
| D432,015 | S | 10/2000 | Holiday | |
| D434,323 | S | 11/2000 | Pattinson | |
| D434,608 | S | 12/2000 | Hansen | |
| D437,233 | S | 2/2001 | Gibert | |
| 6,206,222 | B1 | 3/2001 | Cudzik | |
| D444,385 | S | 7/2001 | Dixon | |
| D451,027 | S | 11/2001 | Dugrot | |
| 6,463,776 | B1 | 10/2002 | Enoki et al. | |
| 6,499,329 | B1 | 12/2002 | Enoki et al. | |
| 6,543,636 | B1 | 4/2003 | Flecheux et al. | |
| 6,761,280 | B2 | 7/2004 | Zonker et al. | |
| 6,779,677 | B2 | 8/2004 | Chupak | |
| 6,857,304 | B2 | 2/2005 | Enoki | |
| D503,343 | S | 3/2005 | Canino | |
| 6,907,653 | B2 | 6/2005 | Chupak | |
| 6,959,830 | B1 | 11/2005 | Kanou et al. | |
| 7,014,060 | B2 | 3/2006 | Richardson | |
| 7,152,766 | B1 * | 12/2006 | Walsh et al. | 222/529 |
| D549,595 | S | 8/2007 | Lowther, Sr. et al. | |
| D570,228 | S | 6/2008 | van Dam | |
| 2001/0040167 | A1 | 11/2001 | Flecheux et al. | |
| 2005/0205575 | A1 | 9/2005 | Kobayashi et al. | |
| 2006/0011633 | A1 | 1/2006 | Cook et al. | |

FOREIGN PATENT DOCUMENTS

| | | | |
|---|---|---|---|
| CA | 678389 | | 1/1964 |
| DE | 4439464 | C1 | 5/1996 |
| DE | 19513886 | A1 | 10/1996 |
| DE | 29512058 | U1 | 12/1996 |
| DE | 19806481 | A1 | 8/1998 |
| DE | 19722628 | A1 | 12/1998 |
| EP | 0281543 | A2 | 9/1988 |
| EP | 0182646 | B1 | 3/1989 |
| EP | 0380662 | A1 | 8/1990 |
| EP | 0510291 | A1 | 10/1992 |
| EP | 0512131 | A2 | 11/1992 |
| EP | 0537773 | A1 | 4/1993 |
| EP | 0549987 | A1 | 7/1993 |
| EP | 0581568 | A1 | 2/1994 |
| EP | 0667299 | A1 | 8/1995 |
| EP | 0693434 | A1 | 1/1996 |
| EP | 0743260 | A1 | 11/1996 |
| EP | 0864385 | A2 | 9/1998 |
| EP | 1134046 | A1 | 9/2001 |
| EP | 1136154 | A1 | 9/2001 |
| EP | 1459997 | A1 | 9/2004 |
| EP | 1468925 | A1 | 10/2004 |
| FR | 633497 | | 1/1928 |
| FR | 2688431 | A1 | 9/1993 |
| FR | 2708252 | A1 | 2/1995 |
| GB | 2330548 | A | 4/1999 |
| GB | 3000547 | | 1/2002 |
| IT | 458853 | | 3/1951 |
| JP | 01210136 | A | 8/1989 |
| JP | 11139438 | A | 5/1999 |
| JP | 2001090898 | A | 4/2001 |
| JP | 2002037442 | A | 2/2002 |
| JP | 2002137032 | A | 5/2002 |
| JP | 2003-181577 | A | 7/2003 |
| JP | 2003-290854 | A | 10/2003 |
| JP | 2007-039095 | A | 2/2007 |
| RU | 50159 | S | 5/2001 |
| RU | 59523 | | 7/2006 |
| WO | 91/11274 | A1 | 8/1991 |
| WO | 96/15865 | A1 | 5/1996 |
| WO | 96/16754 | A1 | 6/1996 |
| WO | 97/42091 | A1 | 11/1997 |
| WO | 98/06636 | A1 | 2/1998 |
| WO | 99/18013 | A1 | 4/1999 |
| WO | 99/32363 | A1 | 7/1999 |
| WO | WO-99/32363 | | 7/1999 |
| WO | 99/43558 | A1 | 9/1999 |
| WO | 99/46176 | A1 | 9/1999 |
| WO | 99/48764 | A1 | 9/1999 |
| WO | 01/15829 | A1 | 3/2001 |
| WO | 03/047991 | A1 | 6/2003 |
| WO | 2005/108216 | A1 | 11/2005 |

* cited by examiner

NECKED-IN CAN BODY AND METHOD FOR MAKING SAME

CROSS-REFERENCE TO RELATED APPLICATIONS

This application is a continuation-in-part application of currently U.S. Design Application. No. 29/262,849, filed Jul. 12, 2006, now U.S. Pat. No. D554,000 S, which is hereby incorporated by reference as if fully set forth herein.

TECHNICAL FIELD

The invention relates to a can body for a two-piece beverage container. More particularly, the present invention is directed to a can body having a novel necked in upper portion with threads and a method for making the can body.

BACKGROUND OF THE INVENTION

Two-piece cans are the most common type of metal containers used in the beer and beverage industry. They are usually formed of aluminum or tin-plated steel. The two-piece can consists of a first cylindrical can body portion having an integral bottom end wall and a second, separately-formed, top end panel portion which, after the can has been filled, is double-seamed thereon to close the open upper end of the container.

An important competitive objective is to reduce the total can weight as much as possible while maintaining its strength and performance in accordance with industry requirements. For pressurized contents such as soft drinks or beer, the end panel must be made of a metal thickness gauge that is on the order of at least twice the thickness of the side wall. Accordingly, to minimize the overall container weight the second end panel should be diametrically as small as possible and yet maintain the structural integrity of the container, the functionality of the end, and also the aesthetically-pleasing appearance of the can.

Beer and beverage marketers have preferred a neck construction having a relatively smooth neck shape between the opening and the diameter can body sidewall. This smooth can neck construction was made by a spin necking process, and apparatus as shown, for example, in U.S. Pat. Nos. 4,058,998 and 4,512,172.

More recently, U.S. Pat. No. 5,497,900 described a die necking method for necking can bodies. The method of the '900 patent contemplates forming a cylindrical neck portion adjacent the cylindrical open end of a container so that the cylindrical neck merged with the cylindrical side wall through a generally smoothly tapered neck portion. The tapered neck portion between the cylindrical neck portion and the cylindrical container side wall initially is defined by a lower, generally arcuate segment having a relatively large internal curvature at the upper end of the cylindrical side wall and an upper, generally arcuate segment having a relatively large external curvature at the lower end of the reduced cylindrical neck. A further tapered portion is then formed at the open end and is forced downwardly while the cylindrical neck is further reduced. The further tapered portion freely integrates with the second arcuate segment which is reformed and the tapered portion is extended. This process is repeated sequentially until the cylindrical neck is reduced to the desired diameter and a smoothly tapered necked-in portion is formed on the end of the side wall. In each necking operation, the tapered portion is not constrained by the die and is freely formed without regard to the specific dimensions of the die transition zone.

The container that is formed by the above die necking process has an aesthetically-pleasing appearance, greater strength and crush resistance and is devoid of the scratches or wrinkles in the neck produced in a spin necking operation. Similar methods are still used today.

More recently, metal beer and beverage containers have produced metal cans to resemble glass bottles. U.S. Pat. Nos. 5,293,765 and 5,822,843 disclose methods and apparatuses for manufacturing threaded aluminum containers which resemble bottles.

One of the drawbacks of producing metal bottles is that the container manufacturer must build new facilities to produce the metal bottle or retrofit current facilities with new tooling to manufacture the metal bottles. Furthermore, the metal bottles are purported to use more than three times the metal used to make an aluminum can.

The present invention is provided to solve the problems discussed above and other problems, and to provide advantages and aspects not provided by prior metal bottles of this type. A full discussion of the features and advantages of the present invention is deferred to the following detailed description, which proceeds with reference to the accompanying drawings.

SUMMARY OF THE INVENTION

One embodiment of the present invention is directed to a metal container. The metal container comprises a lower portion and an upper portion. The lower portion comprises an enclosed bottom and a cylindrical sidewall extending upwardly from the enclosed bottom portion having a diameter. The cylindrical sidewall is centered about a longitudinal axis. The upper portion comprises a circumferential shoulder portion, a circumferential neck, and an open end. The circumferential shoulder portion is integral with an uppermost portion of the cylindrical side wall. The circumferential shoulder is smoothly tapered radially inwardly and has a radius of curvature greater than 0.500 inches (1.27 cm). The circumferential neck extends upwardly and radially inwardly from an uppermost portion of the circumferential shoulder. The open end is connected to the circumferential neck. The open end has threads for threadable attachment to a closure member.

In one aspect the first embodiment, circumferential neck is substantially flat.

In another aspect of the first embodiment, a transition region between the circumferential shoulder and the circumferential neck is substantially flat.

In another aspect of the first embodiment, a height of the upper portion is less than 2.6 inches (6.6 cm).

In another aspect of the first embodiment, a height of the metal container is less than 6.3 inches (16.0 cm).

In another aspect of the first embodiment, the radius of curvature of the circumferential shoulder is between 0.500 inches (1.27 cm) and 1.500 inches (3.81 cm).

In another aspect of the first embodiment, the radius of curvature of the circumferential shoulder is between 0.500 inches (1.27 cm) and 1.100 inches (2.79 cm).

In another aspect of the first embodiment, the radius of curvature of the circumferential shoulder is about 1.00 inches (2.54 cm).

In another aspect of the first embodiment, the radius of curvature of the circumferential shoulder is about 0.62 inches (1.57 cm).

In another aspect of the first embodiment, the angle of the circumferential neck is between 20 and 37 degrees.

In another aspect of the first embodiment, the angle of the circumferential neck is about 22 degrees.

In another aspect of the first embodiment, the angle of the circumferential neck is about 35 degrees.

In another aspect of the first embodiment, the upper portion further comprises a second circumferential shoulder portion integral with an uppermost portion of the circumferential neck. The second circumferential shoulder has a lower concave bend joined to an upper convex bend by an upwardly extending intermediate segment.

In another aspect of the first embodiment, the second circumferential neck is directly connected to the open end.

In another aspect of the first embodiment, the circumferential neck comprises a first radially compressed tapered portion having a single compressed lower segment, and a second further radially compressed tapered portion extending from an upper part of the first tapered portion. The second tapered portion is disposed between the first tapered portion and the open end of the metal container.

In another aspect of the first embodiment, metal container further comprises a containment space for holding a liquid. The containment space has a volume of at least 10 ounces (0.30 liters).

In another aspect of the first embodiment, the metal container further comprises a containment space for a holding a liquid. The containment space has a volume of at least 14 ounces (0.41 liters).

A second embodiment of the present invention is directed to a metal container. The metal container comprises a lower portion and an upper portion. The lower portion comprises an enclosed bottom and a cylindrical sidewall extending upwardly from the enclosed bottom portion having a diameter. The cylindrical sidewall is centered about a longitudinal axis. The upper portion comprises a circumferential shoulder, a substantially flat circumferential neck, and an open end. The circumferential shoulder portion is integral with an uppermost portion of the cylindrical side wall. The circumferential shoulder is smoothly tapered radially inwardly and has a radius of curvature greater than 0.500 inches (1.27 cm). The substantially flat circumferential neck is integral with an uppermost portion of the circumferential neck. The neck extends upwardly and radially inwardly from an uppermost portion of the circumferential shoulder, wherein a transition region between the neck and the shoulder is substantially flat. The open end is connected to the circumferential neck. The open end has threads for threadable attachment to a closure member.

A third embodiment of the present invention is directed to a metal container. The metal container comprises a lower portion and an upper portion. The lower portion comprises an enclosed bottom and a cylindrical sidewall extending upwardly from the enclosed bottom portion having a diameter. The cylindrical sidewall is centered about a longitudinal axis. The upper portion comprises a circumferential shoulder, a circumferential neck, and an open end. The circumferential shoulder portion is integral with an uppermost portion of the cylindrical side wall. The circumferential shoulder is smoothly tapered radially inwardly and has a radius of curvature greater than 0.500 inches (1.27 cm). The circumferential neck extends upwardly and radially inwardly from an uppermost portion of the circumferential shoulder. The open end is connected to the circumferential neck. The open end having threads for threadable attachment to a closure member. The upper and lower portions define a containment space for holding between about 10 (0.30 liters) and about 14 ounces (0.41 liters) of liquid.

Another embodiment of the present invention is directed to a method and apparatus for producing the containers described herein.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
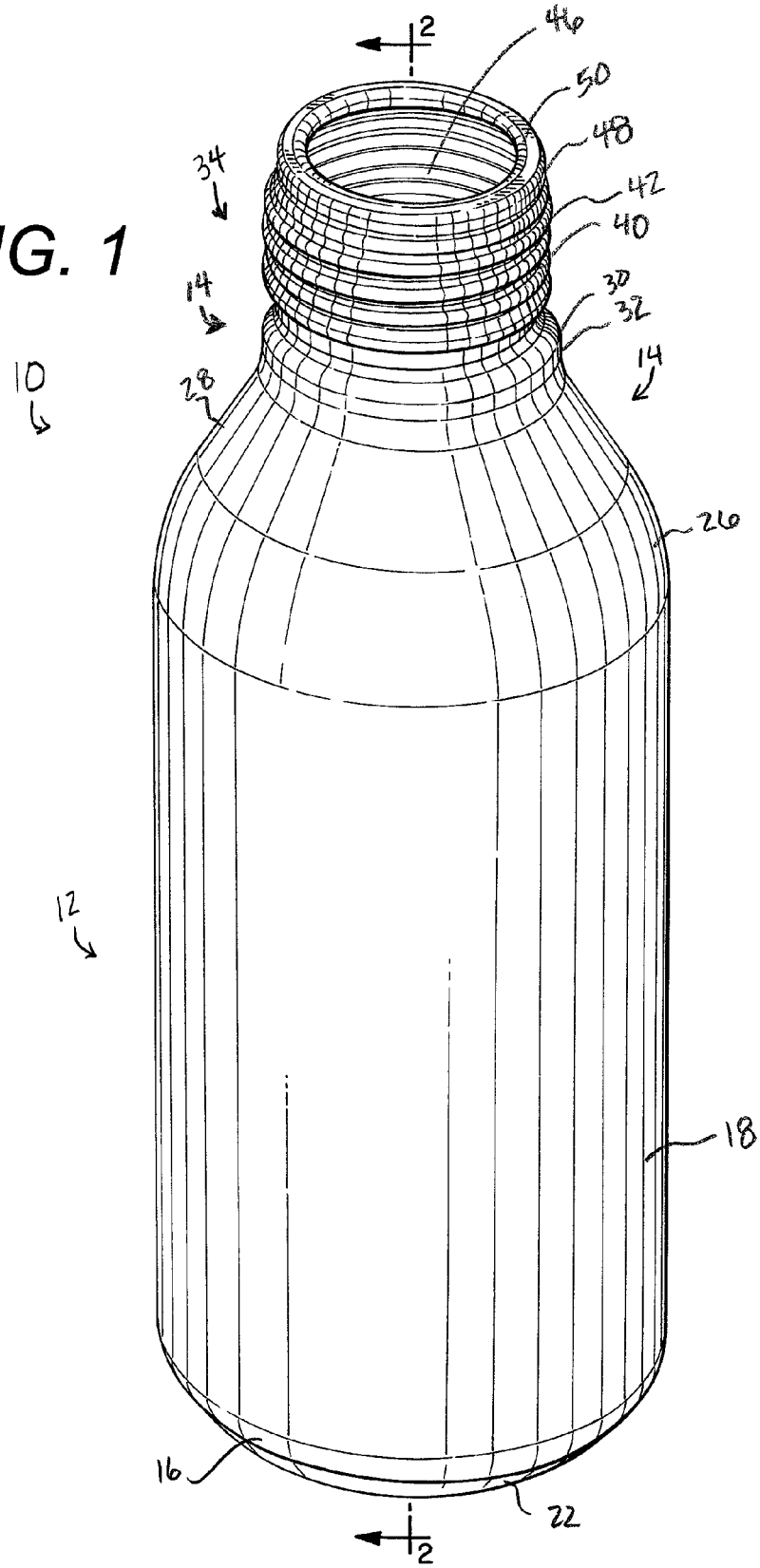
FIG. 1 is a perspective view of a threaded can body of the present invention.
Figure 2:
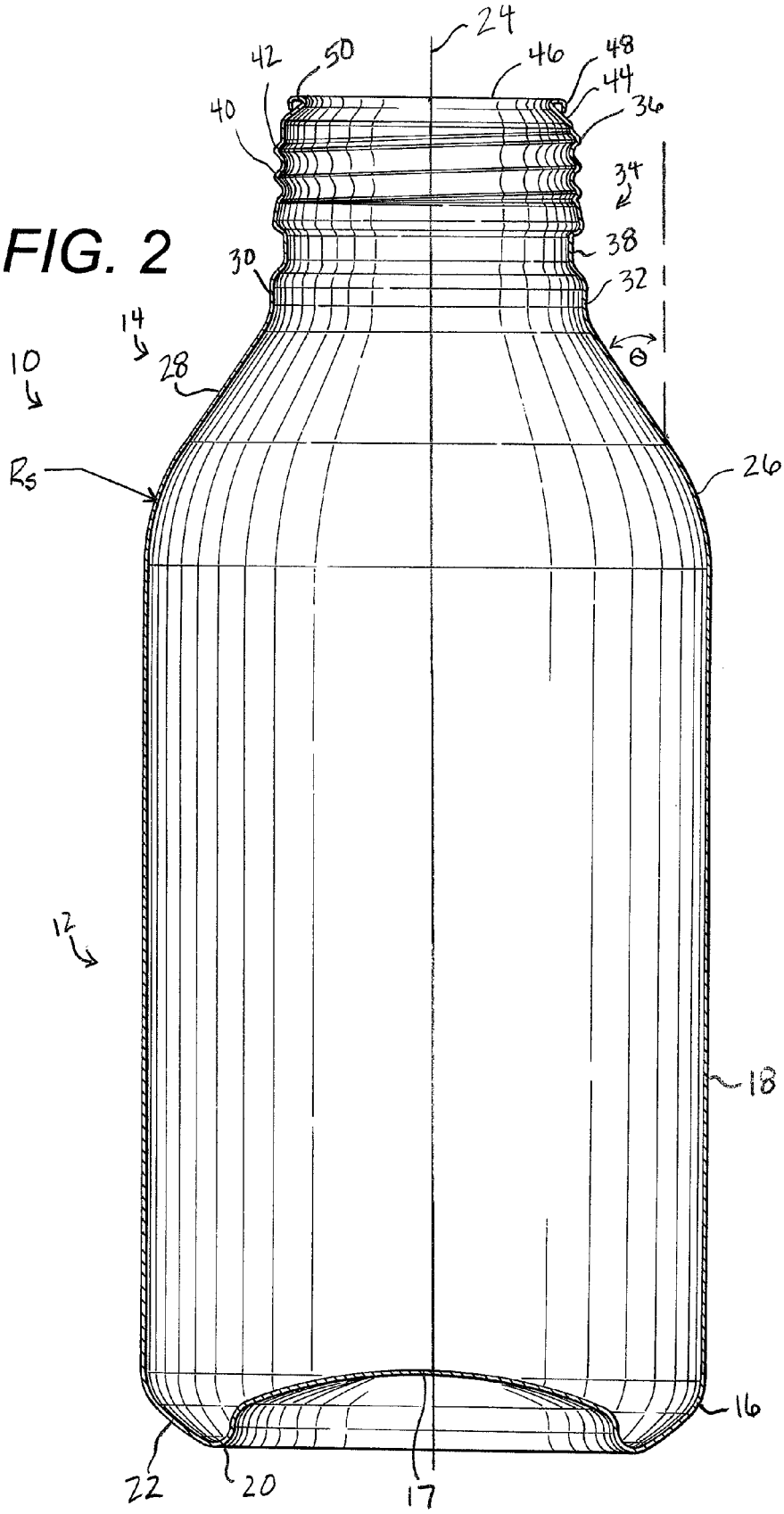
FIG. 2 is a cross-sectional view of the threaded can body of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is directed to two-piece metal containers having threads for threadable attachment of a closure member, such as a threaded cap, to the open end of the metal container.

It is believed that advantages of the metal containers described herein are increased strength through geometric design and improved processing by allowing existing manufacturing facilities to, for the most part, process the threaded metal containers. The applicants further believe that the container described herein has an aesthetically-pleasing appearance, greater strength, and crush resistance. Metal usage may also be reduced by increasing the strength of the container so that required strength is achieved through geometric design rather than increased metal volume, especially thickness. Metal usage is is further decreased by decreasing the size of the open end thereby decreasing the size of the can end required to seal the open end.

Referring to FIGS. 1-6, embodiments of the present invention are illustrated. Generally, the containers 10 of the present invention have a lower portion 12 and an upper portion 14. The upper and lower portions define a containment space for holding between about 8 ounces (0.24 liters) and about 16 ounces (0.48 liters) of liquid, preferably about 10 ounces (0.30 liters) and about 14 ounces (0.41 liters), more preferably 9 ounces (0.27 liters) and 14 (0.41 liters), and most preferably 9.8 ounces (0.29 liters) to 13.6 ounces (0.408 liters), or any range or combination of ranges therein.

The lower portion 12 includes an enclosed bottom 16 and a cylindrical sidewall 18 extending upwardly from the enclosed bottom portion 16.

The bottom 16 has a dome-shaped center panel 17 surround by a generally a circumferential annular support 20. An outer wall 22 extends radially outwardly and upwardly relative to the annular support 20 and joins the bottom 16 with the lowermost portion of the cylindrical sidewall 18.

The cylindrical sidewall 18 is centered about the longitudinal axis 24. In the embodiments illustrated the sidewall 18 is smooth and flat. However, one ordinary skilled in the art would appreciated that any one of a number of forming techniques could be employed to impart a shape and/or texture to the sidewall 18. For instance, the interior of the sidewall 18 could be forced outwardly by a fluid pressure or forming segments, laser treatment could be employed to etch or otherwise mark the sidewall 18, and/or flutes or other designs may be imparted onto the sidewall 18 through mechanical deformation of the sidewall 18.

The upper portion 14 includes a circumferential shoulder portion 26. The shoulder 26 has a convexly curved appearance when viewed from a vantage point external to the container 10. The shoulder 26 has a lowermost point integral with an uppermost portion of the cylindrical sidewall 18. The transition point between the sidewall 18 and shoulder 26 is at a point where the can body 10 begins to curve radially inwardly. Stated another way, the diameter of the container body 10 begins to decrease at the point where the shoulder 26 begins and the sidewall 26 ends.

It is believed that the radius of curvature of the shoulder 26 is important for the aesthetic appearance of the container 10 as well as for the strength of the container 10. It is further believed that these characteristics differentiate the present embodiments for prior art containers of this type. For instance, in the embodiments illustrated, a radius of curvature of the shoulder $R_S$ is greater than 0.500 inches (1.27 cm), preferably 0.500 (1.27 cm) to 1.500 inches (3.81 cm), more preferably 0.500 inches (1.27 cm) to 1.100 inches (2.79 cm). In the embodiment illustrated in FIGS. 1-3, the radius of curvature $R_S$ is 1.000 inches±0.010 inches (2.54 cm±0.0254 cm). In the embodiment illustrated in FIGS. 4 and 5, the radius of curvature $R_S$ is 0.0620 inches±0.010 inches (1.57 cm±0.0254 cm). One ordinary skilled in the art of metal container design would recognize that the radius of curvature $R_S$ could fall within these ranges, or any combination within these ranges without departing form the spirit of the invention.

The shoulder 26 has a smoothly tapered appearance. This appearance is achieved through a die forming technique similar to the die forming technique disclosed in commonly assigned U.S. Pat. No. 5,497,900 which is hereby incorporated by reference as if fully set forth herein. The smoothly tapered appearance differs from containers produced using alternative methods like spin-necking in that the radius of curvature is much greater so that wrinkles and scratches are avoided as is the unsightliness of an abrupt reduction in the diameter of the container caused by a sharp corner or bend at the shoulder. Thus, a vertical length of the shoulder 26, parallel to the longitudinal axis, is greater than the vertical length of shoulders produced through other forming techniques.

The upper portion 14 further includes an inwardly tapered circumferential neck 28. The neck 28 has a lowermost portion integral with an uppermost portion of the shoulder 26. Thus, the neck 28 functions to further decrease the diameter of the container 10 along the vertical length of the neck 28. The neck 28 is preferentially substantially flat, i.e. primarily free of an arc-shape design, although it may have some discontinuity formed during production. An angle θ of the neck 28, measured from a vertical axis parallel to the longitudinal axis, is greater than 10 degrees, preferably 15 to 60 degrees, and more preferably 20 to 37 degrees. The embodiment illustrated in FIGS. 1-3 has an angle θ of 35 degrees±1.5 degrees, and the embodiment illustrated in FIGS. 4 and 5 has an angle θ of 22 degrees±1.5 degrees. One ordinary skilled in the art of container design would appreciate that that the angle θ of the neck 28 could fall within these ranges, or any combination within these ranges without departing from the spirit of the invention. Like the radius of curvature of the shoulder 26, the angle θ of the neck 28 contributes to the novelty and non-obvious (i.e. inventive) nature of the embodiments disclosed herein.

The upper portion 14 also includes a second circumferential shoulder 30 located above the neck 28. This second shoulder 30 is integral with an uppermost portion of the neck 28. This shoulder 30 has a lower concave bend joined to an upper convex bend by an upwardly extending intermediate segment 32. Thus, the second shoulder 30 extends the height of the container 10 as it further decreases the diameter of the container 10, though to a lesser extent than the first shoulder 26.

The upper portion 14 further includes an open end 34. The open end 34 has a thread arrangement 36 for attachment to a closure member, such as a cap. The thread arrangement 36 includes a capper clearance 38 integral with an uppermost portion of the second shoulder 30. The capper clearance 38 receives a radially innermost portion of a cap threadably attached to the container utilizing the thread arrangement 36.

Figure 3:
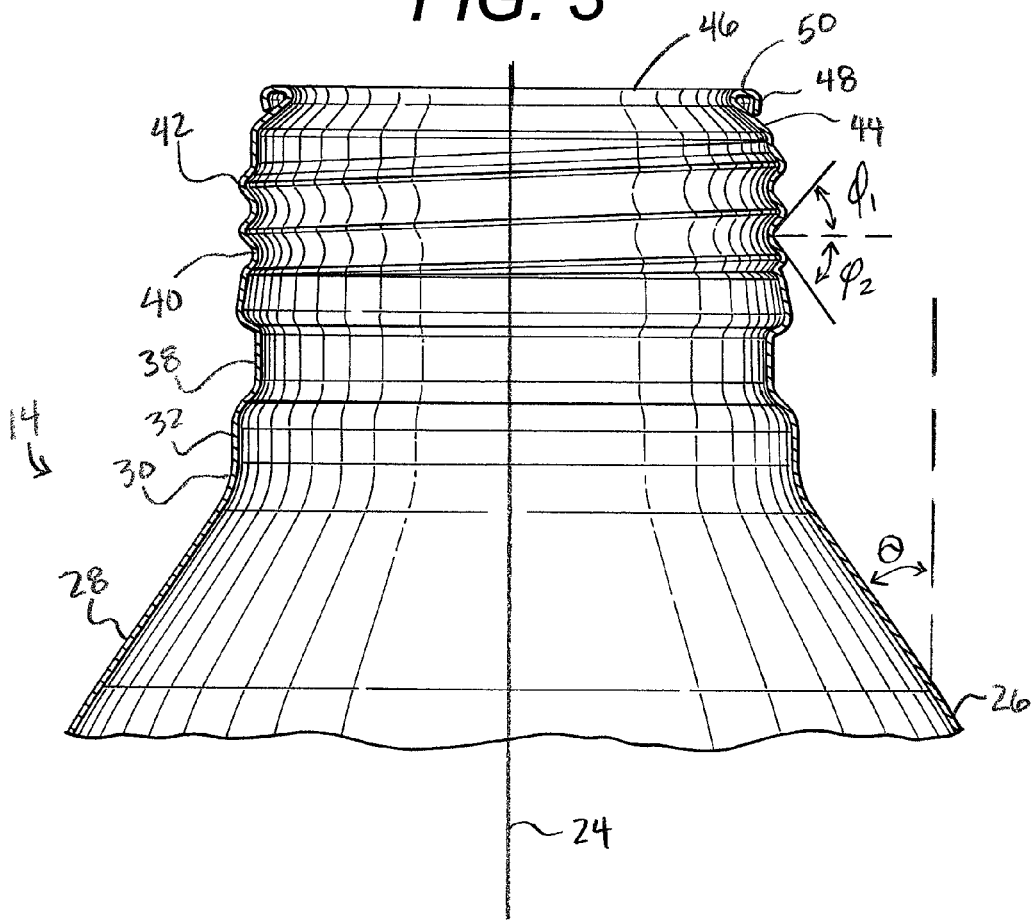
FIG. 3 is a partial cross-sectional view of a segment of the upper portion of a threaded can body.
Figure 4:
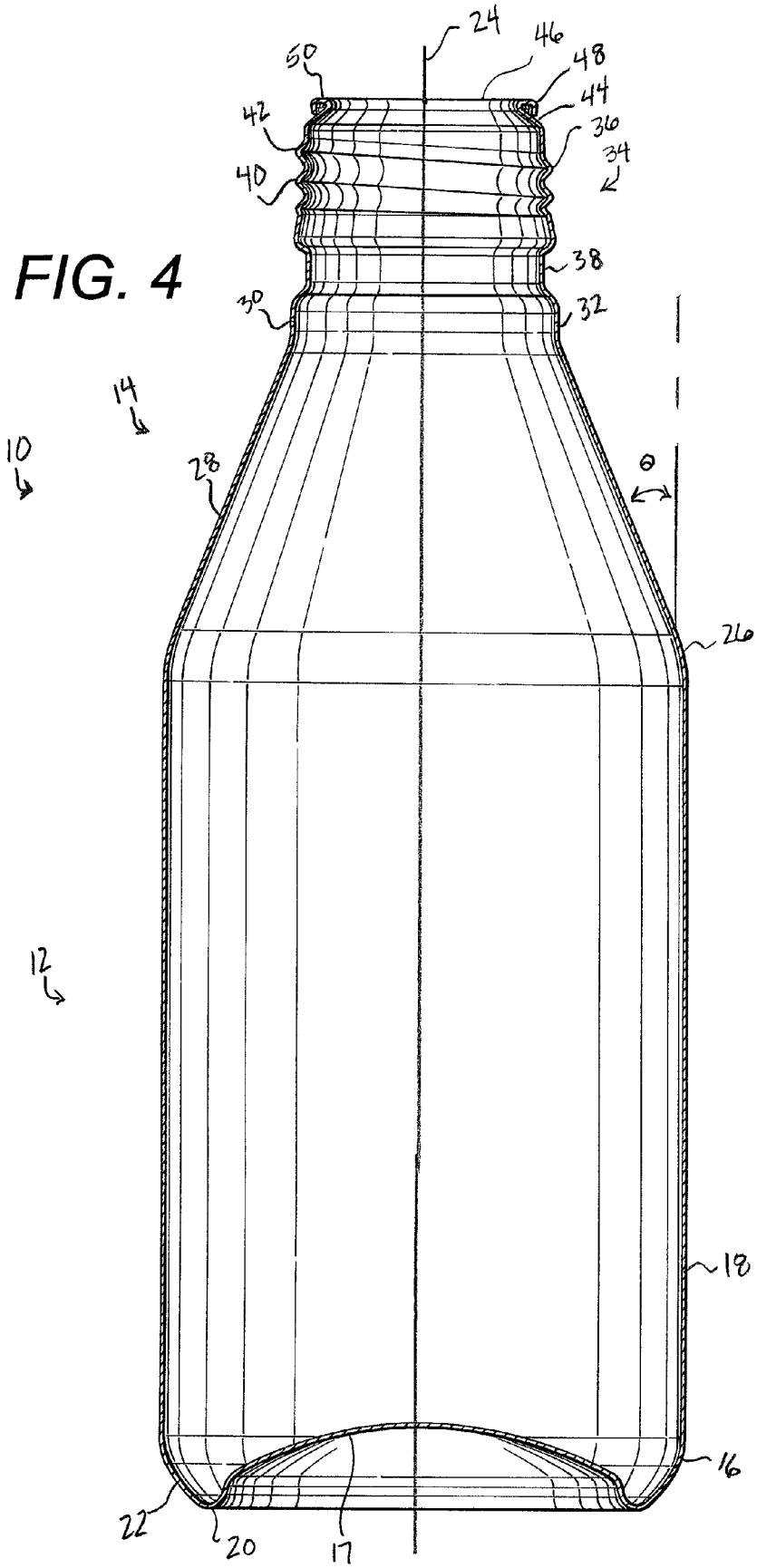
FIG. 4 is a cross-sectional view of an alternative embodiment of a threaded can body.
Figure 5:
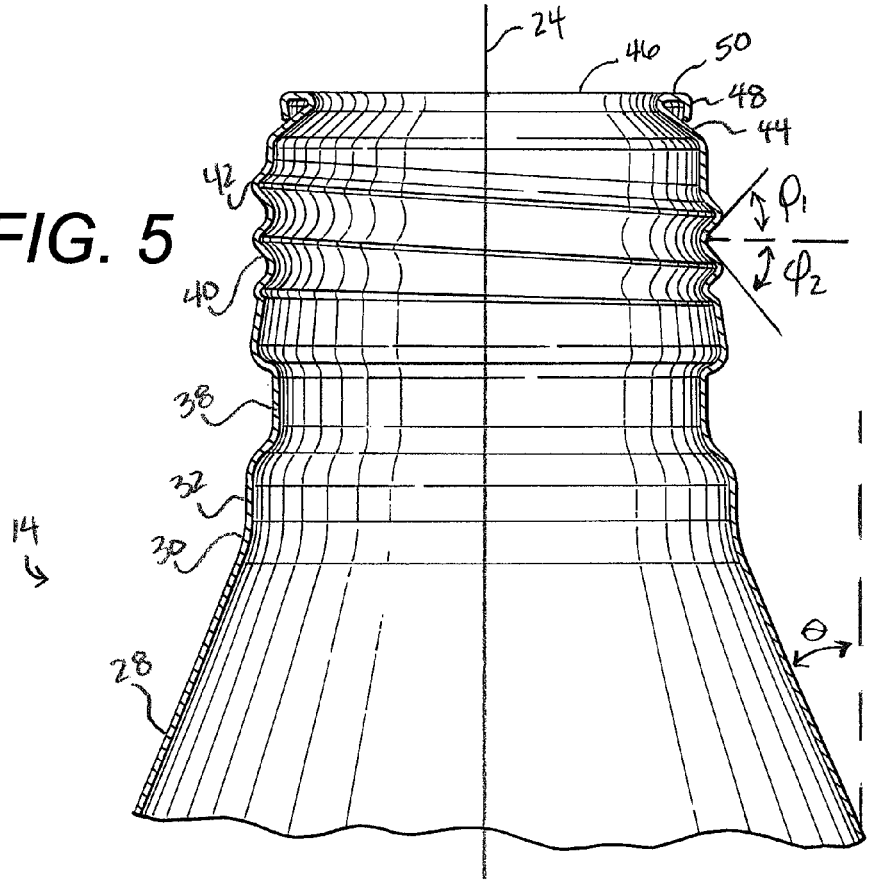
FIG. 5 is a partial cross-sectional view of a segment of the upper end of the threaded can body of FIG. 4.
Figure 6:
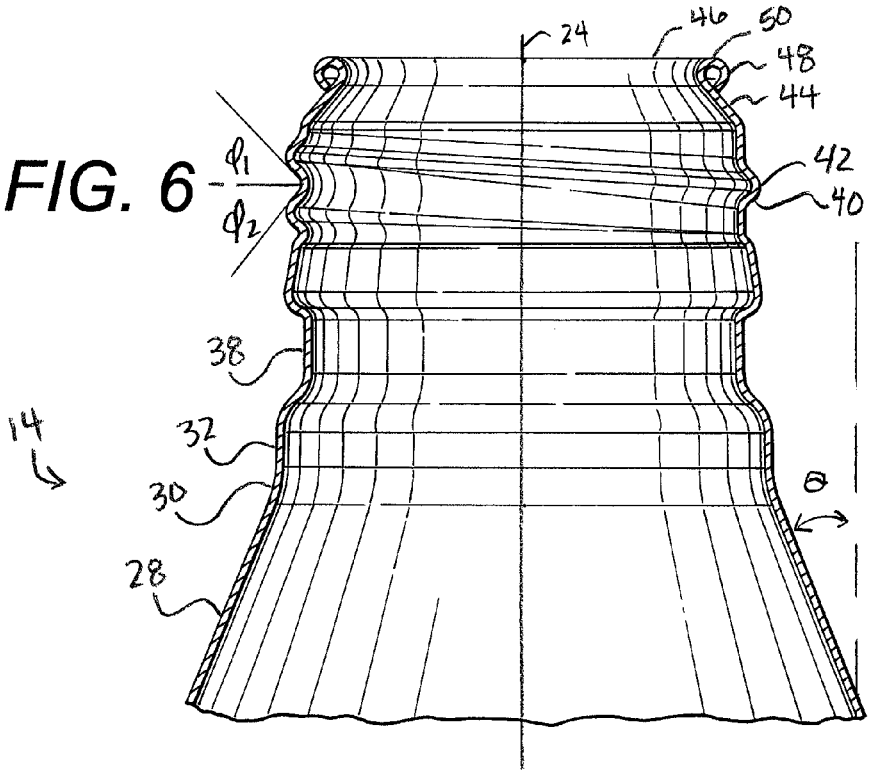
FIG. 6 is a cross-sectional view of an alternative thread arrangement for use in conjunction with the threaded can bodies of FIGS. 2 and 4.

A threaded portion 40 is integral with an uppermost portion of the capper clearance 38. The threaded portion 40 includes a male thread 42 having a thread pitch of about 0.125±005 inches. The male thread 42 has upper and lower thread angles $\phi_1$,$\phi_2$. The upper thread angle $\phi_1$ is measured upwardly from a horizontal axis. The upper thread angle $\phi_1$ is generally between 30 degrees and 70 degrees, more preferably between about 33 degrees to about 60 degrees, and most preferably either 34 degrees±0.5 degrees as illustrated in FIGS. 3 and 5 or 55 degrees±0.5 degrees as illustrated in FIG. 6. The lower thread angle $\phi_2$ is measured downwardly from the horizontal axis. The lower thread angle $\phi_2$ may be equal to the upper thread angle $\phi_1$ or greater than or less than the upper thread angle $\phi_1$, but is preferably between 30 degrees and 70 degrees, more preferably about 33 degrees to about 49 degrees, and most preferably either 46 degrees±0.5 degrees as illustrated in FIGS. 3 and 5 or 48 degrees±0.5 degrees as illustrated in FIG. 6. The threaded portion 40 terminates at a radially inwardly tapered portion 44. One ordinary skilled in the art would appreciate that these angles $\phi_1$,$\phi_2$ may fall within these stated ranges or within any combination of theses stated ranges without departing from the spirit of the invention.

The container opening 46 is defined by a curl 48. The curl 48 has an upper surface 50 which may be curved as shown if FIGS. 3 and 5. Alternatively, the upper surface 50 may have a flat substantially horizontal surface 50 for cooperative sealing with a cap. This upper surface 50 is annular and is generally 0.080±0.005 inches wide. The opening 46 is less than 1.0 inch (25.4 mm) in diameter, typically 0.70 to 1.0 inches (17.8 to 25.4 mm), preferably 0.75 to 0.95 inches (19.1 to 24.1 mm), more preferably 0.80 to 0.90 inches (20.3 to 22.9 mm), and most preferably 0.80±0.010 (20.3±0.25 mm), or any range or combination of ranges therein.

Figure 7:
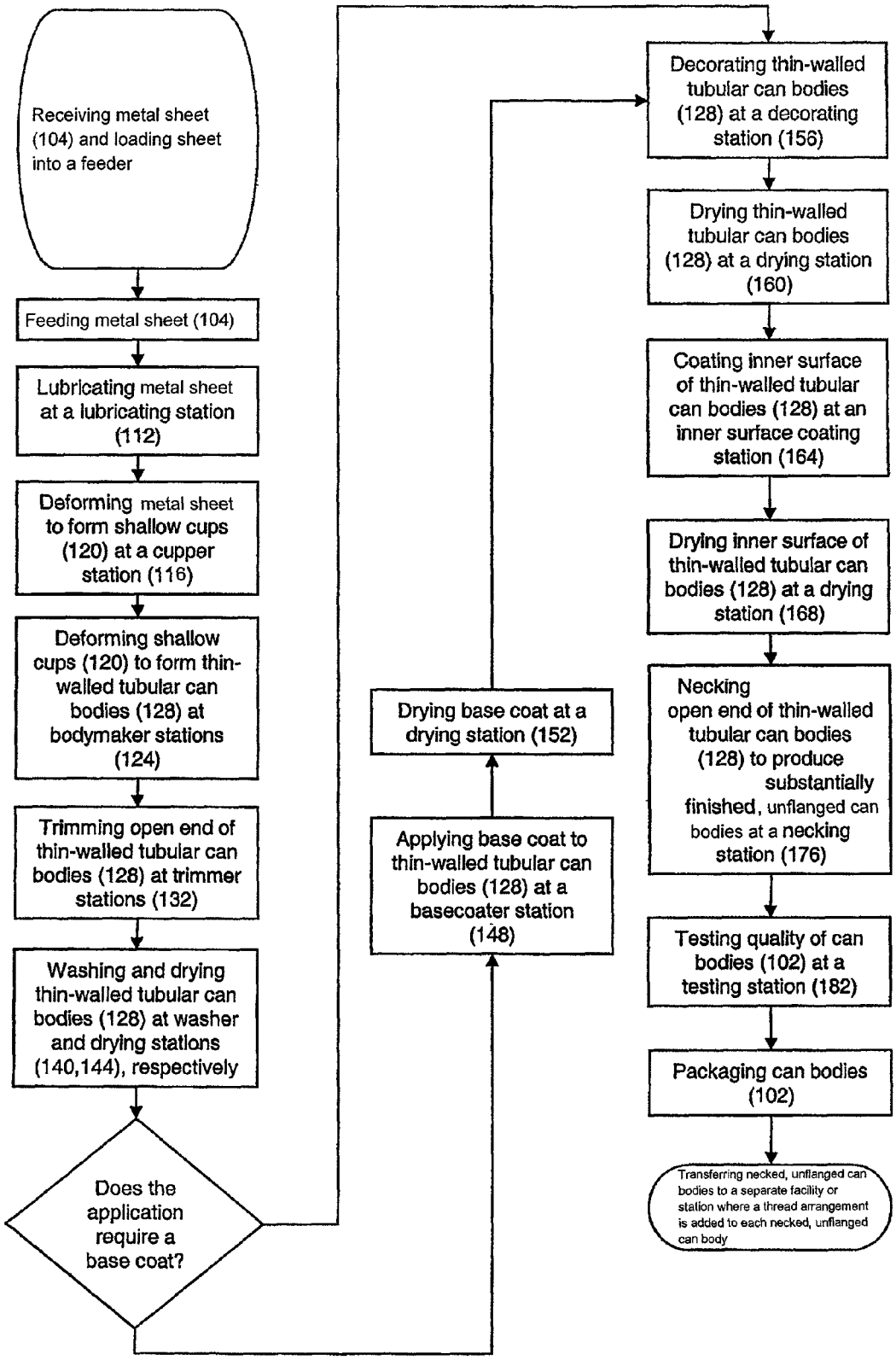
FIG. 7 is a flowchart depicting a method of forming a can body according to an aspect of the present invention.
Figure 8:
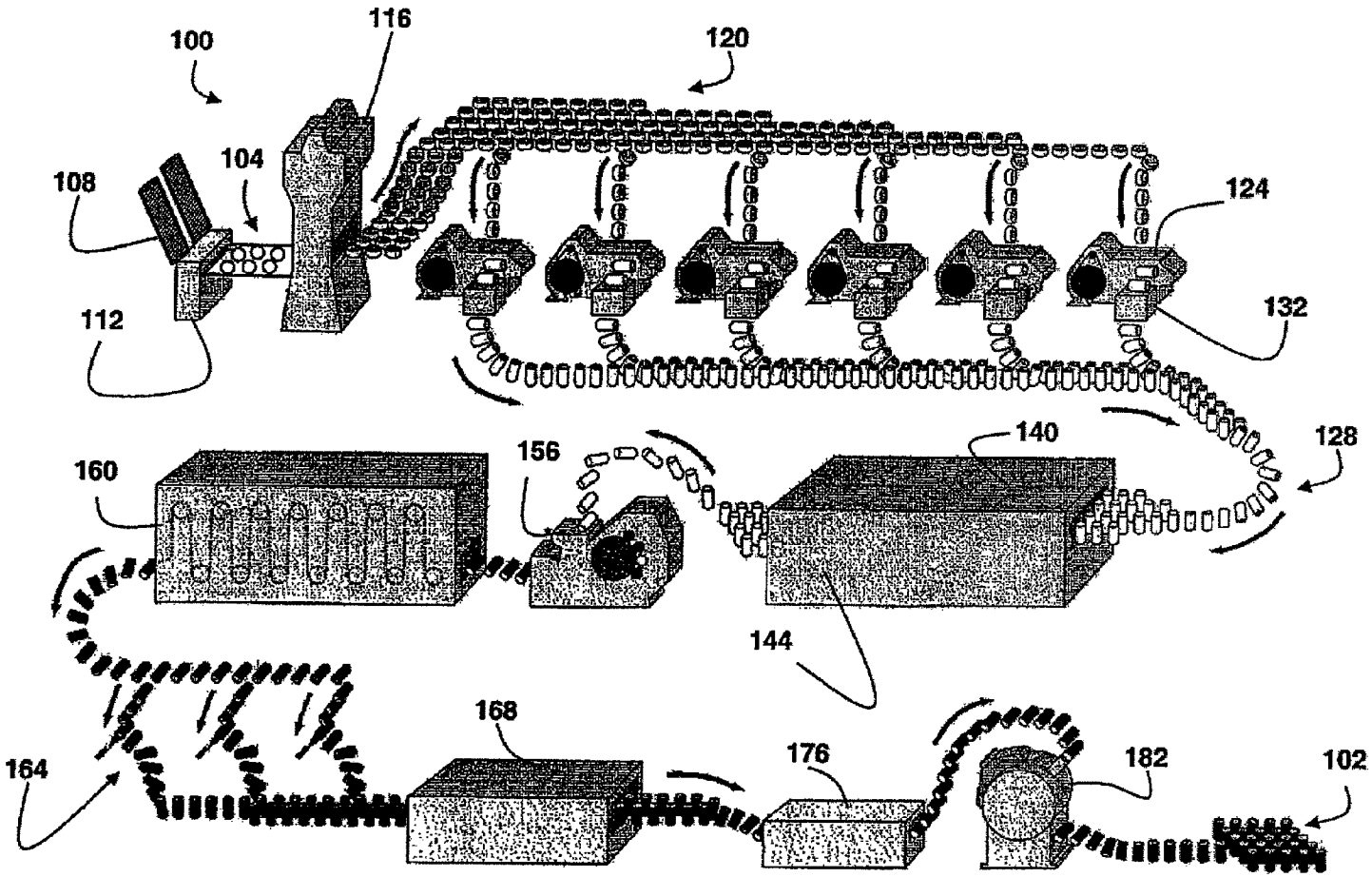
FIG. 8 is a schematic of a can body forming process according to one aspect of the present invention.

Referring to FIGS. 7 and 8, can bodies of the present invention are produced from the second circumferential neck down in conventional can body manufacturing process 100. For instance, flat aluminum sheet is delivered to a cupper station 116, e.g. paid off from aluminum coils or delivered as multiple aluminum disks 104 from a disk feeder. The cupper station 116 deforms the aluminum sheet in a drawing process to form a shallow cup 120. Once complete, the shallow cups 120 drop from the cupper station 116 onto a cup conveyor for transfer to the next station.

The shallow cups 120 are transferred continuously to one or more bodymaker stations 124. Each bodymaker station 124 includes tooling for drawing and thinning the shallow cups 120 to form thin-walled tubular can bodies 128 having an open end and an opposing closed end. Each bodymaker station 124 contains a tool called a punch, which forms the shape of the can body 128 by forcing the cup 120 through a series of progressively smaller circular ironing rings. This action draws the metal up the sides of the punch, ironing it into a can body 128. As the cup 120 is forced through the rings, its diameter is reduced, its walls are thinned and its height is increased. At the end of the punch stroke, the bottom is formed into a dome shape that strengthens the bottom of the can body 128. During this process, referred to as wall ironing, the metal must be lubricated to reduce frictional heat.

The thin-walled, tubular can bodies 128 are transferred from the bodymakers 124 to trimmer stations 132. The trimmer station includes a knife for shearing excess material about the open ends of the tubular can bodies 128. This process adapts the can bodies 128 to a uniform, predetermined height.

The can bodies 128 are then continuously transferred to a washer station 140. The washer 136 removes the forming lubricants before the application of outside decoration (or label) and inside protective coating. The washed can bodies are discharged through a dryer station 144 where the can bodies 128 are dried with forced hot air.

Depending on end user requirements, a base layer of coating can be applied to the outer surface of the can bodies 128 at a base coater station 148. The base coating layer is generally a white or clear base coat. A base coat dryer station 152 may be provided for curing the base coat layer.

The can bodies 128 are then continuously transferred to a decorative coating station 156. The decorative coating station 156 applies a decorative layer of coating (ink) to the outer surface of the thin-walled tubular can bodies 128. The inked can bodies 128 move to a rotating varnish application roll that applies a clear coating over the entire outer sidewall. The clear coating protects the ink from scratching and contains lubricants that facilitate can conveying.

The can bodies 128 are transferred from the decorator 156 onto a pin (so that only the inside surface is contacted) and is conveyed through a decorator coating, or "pin," oven/drier station 160 where the ink is dried with forced hot air.

Following application and curing of the exterior decorative layer, the can bodies 128 are conveyed to an inner surface coater station 164. This station 164 includes a bank of spray machines that spray the inner surfaces of the can bodies 128 with an epoxy-based organic protective coating. The inside coating is also cured by forced hot air at another dryer station 168. The coating prevents the beverage from contacting or reacting with the metal of the inner surface of the can body 128.

The can bodies may be palletized at this point and transferred to another location or separate manufacturing line for further processing. Alternatively, the can bodies can continue to be processed in-line. In either case, the processing continues as described below.

After the can bodies 128 leave the drier station 168, they pass through a lubricator station that applies a thin film of lubricant to the exterior of the top (open end) where a neck and a flange will be formed. A necker station 176 reduces the diameter of the open ends of the can bodies 128, and gives the cans the characteristic neck shape. Here, the diameter of the top of the can is reduced or "necked-in." The necking station includes a plurality of necking modules.

At each module, an open end of the unfinished can body is necked-in or the inwardly-tapered portion is reshaped. A small overlap is created between a previously necked-in portion while the overall necked-in portion is extended and axially enlarged and small segments of reduction are taken so that the various operations blend smoothly into the finished necked-in portion. The resultant necked-in portion has a rounded shoulder on the end of the cylindrical side wall which merges with an inwardly-tapered annular straight neck segment through an arcuate portion, as described above. The opposite end of the annular straight segment merges with the open end through a second arcuate segment.

Prior to this stage of the processing, the unfinished can body has a thickened portion adjacent its upper open end. As the open end of the container is moved into engagement with a necking die, the forming angle in the die results in large radial forces on the container wall and small axial forces so that there is radial compression of the wall of the container.

Figure 9:
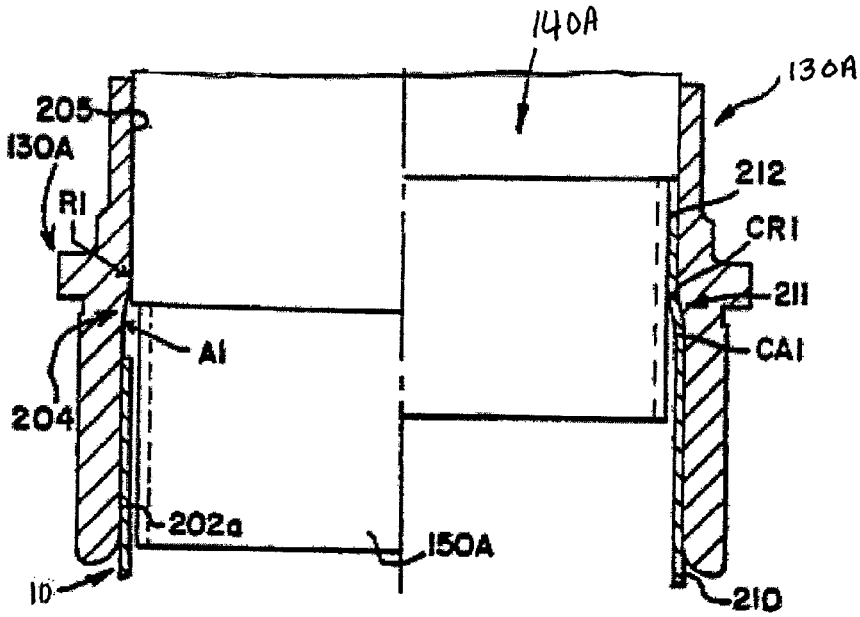
FIG. 9 is an illustration of necking procedure utilized in forming a can body of the present invention.
Figure 10:
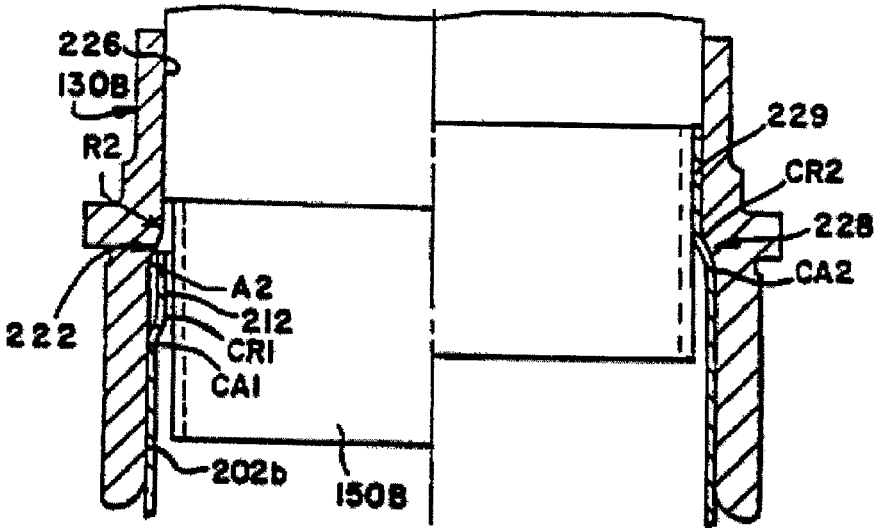
FIG. 10 a second illustration of a necking procedure utilized in forming a can body of the present invention.

As illustrated in FIGS. 9 and 10, as the can body is moved upwardly into the necking die as depicted on the right-hand side of FIG. 9, the diameter of the container neck is reduced and a slight curvature 211 is formed on the container body between the reduced cylindrical neck 212 and the container side wall 210.

The left side portion of FIG. 9 shows a container 10 being moved upwardly into a necking die 130A. As the open end of the container 10 is moved into engagement with the die, the forming angle in the die results in large radial forces on the container wall and small axial forces so that there is radial compression of the wall of the container, as will become clear.

FIG. 9 shows a necking die 130A having a first cylindrical wall portion 202*a*, a transition zone surface 204, and a second cylindrical wall portion 205. The first cylindrical wall portion 202*a* has a diameter approximately equal to the external diameter of the container 10 with a clearance of about 0.006 inch. The second cylindrical wall portion 205 has a reduced diameter equal to the external diameter of the reduced neck that is being formed in the first necking operation.

The transition zone or intermediate surface 204 has a first arcuate surface segment A1 at the end of the first cylindrical wall portion 202 which has a radius of about 0.220 inch and a second arcuate surface segment R1 at the end of the second cylindrical wall portion 205 which has a radius of about 0.120 inch.

As the container 10 is moved upwardly into the die element 130A, as depicted on the right-hand side of FIG. 9, the diameter of the container neck is reduced and a slight curvature 211 is formed on the container body between the reduced cylindrical neck 212 and the container side wall 210.

In the first necking module, the diameter of the container 10 is reduced only a very small amount while the portion of the can body to be necked is conditioned for subsequent operations. In other words, a form control operation is performed on the ultimate neck portion to prepare the container for subsequent operations.

This is accomplished by tightly controlling the dimensions and tolerances of reduced cylindrical surface 205 of die 130A and the external surface diameter of the forming sleeve or element 150A. The external diameter of sleeve or element 150A is equal to the internal diameter of cylindrical surface 205 less two times the thickness of the container side wall (t) with a maximum of 10% clearance of the wall thickness. By thus tightly controlling these dimensions, dents or imperfections in the container are removed or minimized, and also any variations in wall thickness around the perimeter of the neck are reduced to provide concentricity of the side wall of the container with the die.

Also, as mentioned above, during the movement of container 10 from the position illustrated at the left of FIG. 9 to the position at the right of FIG. 9, pressurized air may be introduced into the container 10 to pressurize it, if considered necessary, and thereby temporarily strengthen the container 10. This air is used primarily to strip the container from the necking die 130A after the necking operation is completed. As explained above during the upward movement of the container 16, the forming control member 140A and forming sleeve or element 150A are moved upwardly slightly faster than the container 10 to aid in drawing or pulling the metal of the container wall into the die.

At the first forming station, the die element 130A forms the container 10 to have a shoulder 211 between a cylindrical side wall 210 and a reduced cylindrical neck 212; the shoulder 211, at this point, includes first and second arcuate segments CA1, CR1, respectively.

After the first necking operation is completed, the partially-necked container 10 exits therefrom and is fed to the second necking module. In the second necking operation, the necked-in portion is axially elongated while the reduced cylindrical neck portion 212 is further reduced in diameter by compression of the metal therein. This is accomplished by a second necking die 130B (FIG. 10) that has a transition zone 222 between a cylindrical first surface 202*b*, which has the same internal diameter as the external diameter of the container, and a reduced cylindrical surface 226 at the upper end thereof. The transition zone 222 has a first arcuate surface segment A2 integral with the cylindrical wall surface 202*b* and a second arcuate surface segment R2 integral with the reduced diameter cylindrical surface 226.

Referring to FIG. 10, the surface 222 of die element 130B of the second necking station initially engages the upper edge of the container 10 with arcuate die surface R2 at a small acute forming angle.

As the container is moved from the left-hand position, shown in FIG. 10, to the right-hand position, the original tapered portion is axially elongated to further form a shoulder 228 having arcuate segments CA2, CR2 while the neck 212 is reduced to a further reduced diameter, as shown at 229.

In the second necking operation, the diameter of the reduced cylindrical neck is reduced, while the metal is further radially compressed therein. In the second necking die 130B, the forming angle described above is defined by the arcuate surface segment R2. It will be noted that the lower segment of the shoulder adjacent the cylindrical sidewall remains substantially unchanged while the upper part is reformed and the tapered portion is axially elongated.

During the second operation, a second tapered portion is essentially freely formed in the reduced cylindrical neck being free of the die at its lower end and this second tapered portion is forced along the reduced neck portion until it integrates with the arcuate segment CR1 of the first tapered portion. During this second operation, the lower part of the first tapered portion remains essentially unchanged while the second tapered portion combines and blends with the first tapered portion to produce an extension thereof and part of the finished shoulder.

It will be appreciated that the necking operation performed at each of the various modules is somewhat repetitive. It should be appreciated that, in fact, each module performs a part, and not all, of the necked-in portion while the cylindrical neck is sequentially and progressively reduced in diameter. That is, each module adds to and at least partially reforms and extends the necked-in portion produced on the container by the previous operation.

At each subsequent station, the cylindrical neck is compressed and reduced while the existing tapered or necked-in portion is partially reformed and axially elongated or extended to produce a small annular inwardly-tapered portion between the upper and lower arcuate segments described above.

Thus, the necking operation forms a smooth tapered necked-in portion between the container side wall and the reduced diameter cylindrical neck. This necked-in portion or taper includes a first arcuate segment integral with the side wall and a second arcuate segment integral with the reduced cylindrical neck. During the necking operation, the neck, comprising the reduced diameter cylindrical neck and the necked-in portion, is formed in segments while the axial dimension is increased and the cylindrical neck is further reduced in diameter and in axial length while a rounded shoulder is formed at the end of the side wall. At the same time, a straight tapered wall section or segment is created in the necked-in or tapered portion.

In each of the necking modules, the principal forces applied to the upper portion of the can body, which includes the first shoulder, the tapered neck, and the open end, are radially inwardly-directed forces and therefore the metal is primarily compressed and localized bending is minimized. The tapered portion is allowed to determine its profile because it is not constrained by the die below the contact area and is thus not dependent on the configuration of the lower portion of the transition zone of the die. Of course, the forming sleeve or element 150 will direct the upper edge of the container 16 into the annular slot defined between the forming sleeve or element and the reduced cylindrical portion of the die 130. Stated another way, the forming element 150 which engages the inner surface of the container 16 provides a guiding function or form control function.

The resultant can body comprises a cylindrical side wall extending from an integral bottom end wall, a single smooth necked in shoulder portion at an end of the cylindrical side wall, a single inwardly tapered annular straight segment extending from the shoulder between the sidewall and an open end of the can body. The inwardly tapered annular straight segment comprises a first radially compressed tapered portion having a single compressed lower segment, and a second further radially compressed tapered portion extending from an upper part of the first tapered portion. The second tapered portion is disposed between the first tapered portion and the open end. Subsequent necking modules would result in additional tapered portions. Thus, a plurality of tapered portions will be produced, preferably between eighteen and thirty-nine in number. More preferably a trim operation occurs after an eighteenth necking operation; a second trim operation and an expansion operation are carried out after the thirty-first necking operation; threads are produced in a threading operation after a thirty-fifth necking operation, and the end curl is provided in a curling operation which takes place after a thirty-ninth necking operation. This is all done on the necking station as a continuous sequence.

As stated before, method can be carried out on-line for a continuous sequence from cupping to finished threaded can body. Alternatively, the can bodies of the present invention are not flanged at the necking station, and may be removed from the typical process after the drying station 168.

While the specific embodiments have been illustrated and described, numerous modifications come to mind without significantly departing from the spirit of the invention, and the scope of protection is only limited by the scope of the accompanying Claims.

What is claimed is:

1. A metal container, the metal container comprising:

a lower portion comprising:

an enclosed bottom; and a cylindrical sidewall extending upwardly from the enclosed bottom portion having a diameter, the cylindrical sidewall centered about a longitudinal axis;

and an upper portion comprising:

a circumferential shoulder portion integral with an uppermost portion of the cylindrical side wall, the circumferential shoulder smoothly tapered radially inwardly, wherein a radius of curvature of the circumferential shoulder is between 0.500 inches (1.27cm) and 1.100 inches (2.79cm);

a circumferential neck extending upwardly and radially inwardly from an uppermost portion of the circumferential shoulder; and an open end connected to the circumferential neck, the open end having threads for threadable attachment to a closure member.

2. The metal container of claim 1 wherein the circumferential neck is substantially flat.

3. The metal container of claim 1 wherein a transition region between the circumferential shoulder and the circumferential neck is substantially flat.

4. The metal container of claim 1 wherein a height of the upper portion is less than 2.6 inches (6.6cm).

5. The metal container of claim 1 wherein a height of the metal container is less than 6.3 inches (16.0cm).

6. The metal container of claim 1 wherein a radius of curvature of the circumferential shoulder is about 1.00 inches (2.54cm).

7. The metal container of claim 1 wherein a radius of curvature of the circumferential shoulder is about 0.62 inches (1.57cm).

8. The metal container of claim 1 wherein an angle of the circumferential neck measured from a vertical axis is between 15 and 60 degrees.

9. The metal container of claim 1 wherein an angle of the circumferential neck measured from a vertical axis is between 20 and 37 degrees.

10. The metal container of claim 1 wherein an angle of the circumferential neck measured from a vertical axis is about 22 degrees.

11. The metal container of claim 1 wherein an angle of the circumferential neck measured from a vertical axis is about 35 degrees.

12. The metal container of claim 1 wherein the upper portion further comprises a second circumferential shoulder portion integral with an uppermost portion of the circumferential neck, the second circumferential shoulder having a lower concave bend joined to an upper convex bend by an upwardly extending intermediate segment.

13. The metal container of claim 12 wherein the second circumferential shoulder is directly connected to the open end.

14. The metal container of claim 1 wherein the circumferential neck comprises a first radially compressed tapered portion having a single compressed lower segment, and a second further radially compressed tapered portion extending from an upper part of the first tapered portion, the second tapered portion disposed between the first tapered portion and the open end of the metal container.

15. The metal container of claim 1 further comprising a containment space for holding a liquid, the containment space having a volume of about 10 ounces (0.30 liters).

16. The metal container of claim 1 further comprising a containment space for a holding a liquid, the containment space having a volume of about 14 ounces (0.41 liters).

* * * * *